US010476120B2

(12) United States Patent
Kim et al.

(10) Patent No.: US 10,476,120 B2
(45) Date of Patent: Nov. 12, 2019

(54) MULTI-PORT PHASE SHIFTER WITH MULTIPLE LINES FORMED ON OPPOSITE SURFACES OF A GROUND

(71) Applicant: GAMMANU CO., LTD., Hwaseong-si, Gyeonggi-do (KR)

(72) Inventors: Sang Jin Kim, Hwaseong-si (KR); Ju Yeol Baek, Hwaseong-si (KR); Kyoung Sub Oh, Goyang-si (KR)

(73) Assignee: GAMMANU CO., LTD., Hwaseong-si (KR)

( * ) Notice: Subject to any disclaimer, the term of this patent is extended or adjusted under 35 U.S.C. 154(b) by 0 days.

(21) Appl. No.: 15/536,081

(22) PCT Filed: Nov. 6, 2015

(86) PCT No.: PCT/KR2015/011903

§ 371 (c)(1),
(2) Date: Jun. 14, 2017

(87) PCT Pub. No.: WO2016/111449

PCT Pub. Date: Jul. 14, 2016

(65) Prior Publication Data

US 2017/0346183 A1 Nov. 30, 2017

(30) Foreign Application Priority Data

Jan. 9, 2015 (KR) ..... 10-2015-0003411

(51) Int. Cl.
*H01P 1/18* (2006.01)
*H01Q 3/36* (2006.01)

(52) U.S. Cl.
CPC ..... *H01P 1/184* (2013.01); *H01Q 3/36* (2013.01)

(58) Field of Classification Search
CPC ..... H01P 1/184; H01P 1/18; H01P 9/00
(Continued)

(56) References Cited

U.S. PATENT DOCUMENTS

2003/0076198 A1* 4/2003 Phillips et al. ..... H01P 1/184 333/161
2008/0180191 A1* 7/2008 Kim et al. ..... H01P 1/184 333/161

(Continued)

FOREIGN PATENT DOCUMENTS

CN 202523820 U 11/2012
KR 10-2007-0120281 A 12/2007

(Continued)

*Primary Examiner* — Benny T Lee
(74) *Attorney, Agent, or Firm* — Maschoff Brennan

(57) ABSTRACT

A multi-port phase shifter includes a ground, a first line on one surface of the ground, a second line on the other surface of the ground, a third line spaced at a predetermined distance from the upper surface of the first line and facing a part of the first line, and a fourth line spaced at a predetermined distance from the upper surface of the second line and facing a part of the second line. A via hole penetrates the ground. A power supply line on the one surface of the ground includes a region having the via hole. Multiple ports make the phase shifter applicable to a sector antenna for obtaining a high gain. Phase shifter volume can be reduced by implementing multiple ports in one phase shifter without coupling two or more phase shifters, thereby eliminating an additional component such as a fixing pole or a connecting pole.

16 Claims, 16 Drawing Sheets

100

(58) Field of Classification Search
USPC ..... 333/161
See application file for complete search history.

(56) References Cited

U.S. PATENT DOCUMENTS

| | | | | |
|---|---|---|---|---|
| 2009/0189826 | A1 | 7/2009 | Timofeev et al. | |
| 2009/0195329 | A1 | 8/2009 | Kim et al. | |
| 2011/0063049 | A1* | 3/2011 | Bradley et al. ..... | H01P 1/184<br>333/161 |

FOREIGN PATENT DOCUMENTS

| | | | |
|---|---|---|---|
| KR | 10-1075983 | B1 | 10/2011 |
| KR | 10-1150465 | B1 | 6/2012 |
| KR | 10-2012-0130362 | A | 12/2012 |

* cited by examiner

100

100

MULTI-PORT PHASE SHIFTER WITH MULTIPLE LINES FORMED ON OPPOSITE SURFACES OF A GROUND

FIELD

The present invention relates to a multi-port phase shifter, and more particularly, to a multi-port phase shifter formed by stacking dielectric substrates on which lines are formed.

BACKGROUND

A phase shifter is a device for electrical beam tilting, which generates a phase difference of an input signal supplied to respective antenna radiating elements arranged in a row, thereby enabling electrical beam tilting. Specifically, a phase shifter may be implemented by generating a phase difference between the input signal and the output signal by appropriately delaying the supplied input signal and changing the physical length of the entire transmission line.

FIG. 1 is a view showing a conventional phase shifter, in which a variable substrate on which a second transmission line is formed is coupled to a top surface of a fixed substrate having a first transmission line formed on one surface thereof, and the variable substrate is rotated by a predetermined angle, thereby changing the physical length of the entire transmission line formed by connecting the two transmission lines to enable electrical beam tilting. However, since the overall structure of the phase shifter is a single layer, it is impossible to implement a multi-port shifter.

In addition, a sector antenna, which is commonly used according to recent developments of mobile communication technology, adopts a variable tilt method in order to obtain a high gain. To this end, a phase shifter is required to have multiple ports. If the phase shifter is implemented with multiple ports, the total volume of the phase shifter becomes larger than when the phase shifter is implemented with a single port, and thus installation thereof may be spatially restricted. Accordingly, the volume needs to be reduced.

Therefore, the present invention proposes a new multi-port phase shifter with a minimized volume that can implement multiple ports and thus be applied to a sector antenna for obtaining a high gain.

SUMMARY

It is an object of the present invention to provide a phase shifter capable of implementing multiple ports.

It is another object of the present invention to provide a phase shifter capable of implementing multiple ports and minimizing the total volume thereof.

The present invention is not limited to the objects mentioned above, and various objects can be derived from the disclosure below within a range that is obvious to those skilled in the art.

In accordance with one aspect of the present invention, provided is a multi-port phase shifter including a ground, a first line formed on one surface of the ground, a second line formed on the other surface of the ground, a third line spaced apart from an upper surface of the first line by a predetermined distance and arranged to partially face the upper surface, a fourth line spaced apart from an upper surface of the second line by a predetermined distance and arranged to partially face the upper surface, a via hole formed through the ground, and a feed line formed on the one surface of the ground so as to include an area where the via hole is formed.

According to the present invention, since it is possible to implement multiple ports in one phase shifter, a phase shifter applicable to a sector antenna for obtaining a high gain may be provided. Further, since it is possible to implement multiple ports without combining two or more phase shifters, additional components such as a fixing column or a connecting column required to couple two or more phase shifters are not required. Therefore, the volume of the phase shifter may be remarkably reduced.

The first line may receive an input signal through a coupling effect with the feed line, and the second line may receive an input signal through a coupling effect with the via hole included in the feed line. The third line may receive the input signal through a coupling effect with the first line and the via hole, and the fourth line may receive the input signal through a coupling effect with the second line and the via hole.

The via hole may include a plurality of via holes formed through the ground, and the entire inner surfaces of the via holes may be covered with a conductive material.

Meanwhile, the third line and the fourth line are rotatable by a predetermined angle counterclockwise or clockwise. The third line and the fourth line may be connected to a motor, and the motor may be controlled remotely by a remote controller to rotate the third line and the fourth line by the predetermined angle.

In addition, a feed cable may be connected to the feed line. The first line may be divided into two or more ports by the third line, and the second line may be divided into two or more ports by the fourth line.

The first line may include two or more lines formed facing in opposite directions, and the second line may include two or more lines formed facing in opposite directions. The two or more lines included in the first line may have different lengths, and the two or more lines included in the second line may have different lengths.

Meanwhile, the second line may be arranged at an angle of 90° with respect to the first line, and the first to fourth lines may be individually formed on first to fourth dielectric substrates. One or more via holes may be additionally formed at both ends of the first and second dielectric substrates, wherein the first and second lines may be supplied with electricity by the one or more via holes formed at both ends of the first and second dielectric substrates.

According to embodiments of the present invention, since it is possible to implement multiple ports in one phase shifter, a phase shifter applicable to a sector antenna for obtaining a high gain may be provided.

Further, since it is possible to implement multiple ports without combining two or more phase shifters, additional components such as a fixing column or a connecting column required to couple two or more phase shifters are not required. Therefore, the volume of the phase shifter may be remarkably reduced.

The present invention is not limited to the above-mentioned effects, and may include various effects within a scope that is apparent to those skilled in the art from the following description.

Figure 1:
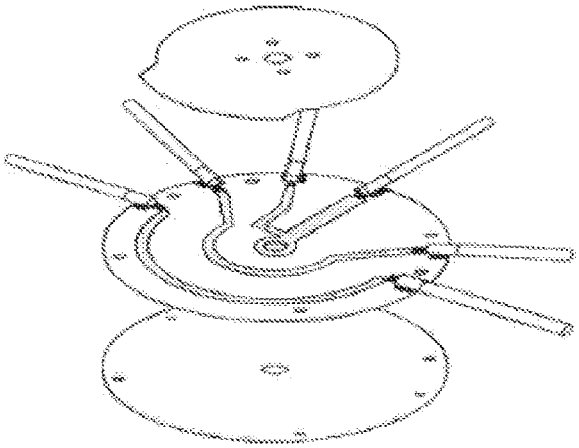
FIG. 1 PRIOR ART
FIG. 1 is a view showing a conventional phase shifter.

The reference numerals used in the drawings are listed below.

100: Multi-port phase shifter
5: Ground
10: First line
20: Second line
30: Third line
40: Fourth line
50: Via hole
60: Feed line

DESCRIPTION OF EMBODIMENTS

Hereinafter, some embodiments of the present invention will be described in detail with reference to exemplary drawings. The embodiments described below are provided so that those skilled in the art can easily understand the technical idea of the present invention, and thus the present invention is not limited thereto. A detailed description of related known configurations or functions incorporated herein will be omitted for the purpose of clarity and for brevity.

Embodiments of the present invention may be implemented in many different forms and should not be construed as limited to the embodiments illustrated in the drawings. It should be noted that the same reference numerals are given to the same elements even if they are shown in different drawings.

In addition, the expression "comprising" is an open-ended term that merely denotes that certain elements exist, and should not be construed as excluding additional elements.

Figure 2:
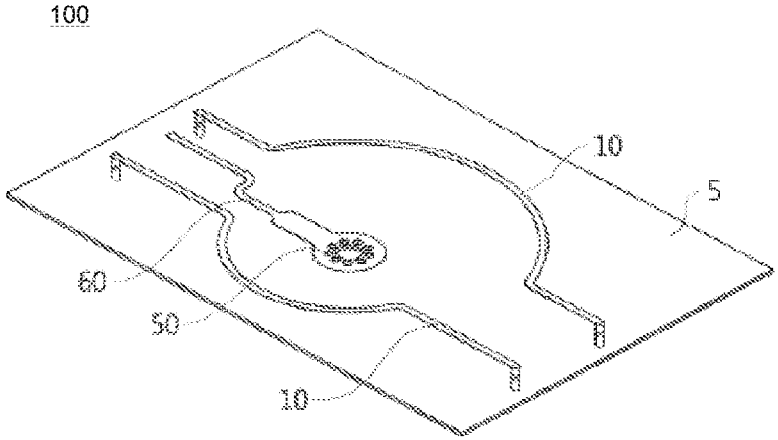
FIG. 2 is a top view illustrating a multi-port phase shifter according to an embodiment of the present invention.
Figure 3:
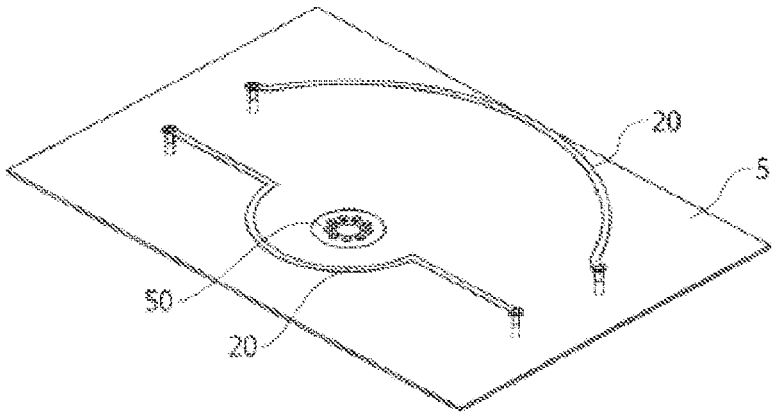
FIG. 3 is a bottom view illustrating the multi-port phase shifter according to an embodiment of the present invention.

FIG. 2 is a top view illustrating a multi-port phase shifter 100 according to an embodiment of the present invention, and FIG. 3 is a bottom view illustrating the multi-port phase shifter.

The phase shifter 100 may include a ground 5, a first line 10 (FIG. 2), a second line 20 (FIG. 3), a third line 30 (FIG. 14), a fourth line 40 (FIG. 15), and a feed line 60 (FIG. 2) formed on one surface of the ground 5.

Figure 4:
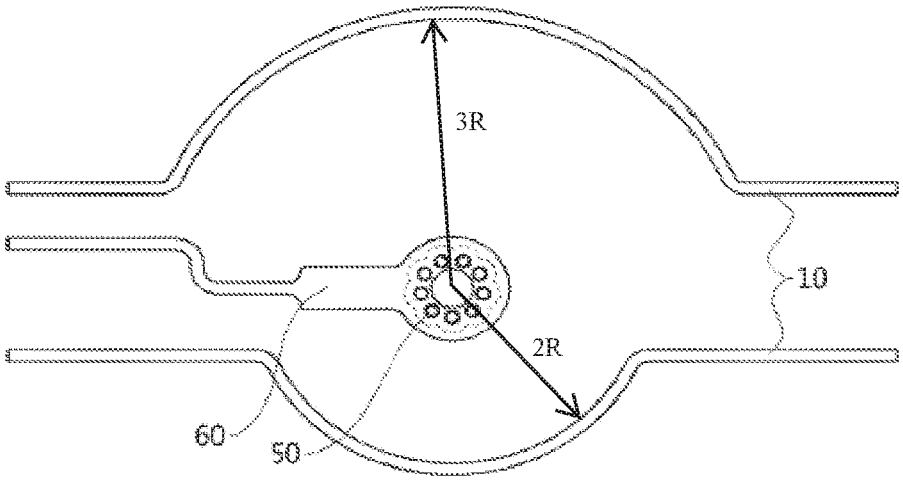
FIG. 4 is a view showing a first line.
Figure 5:
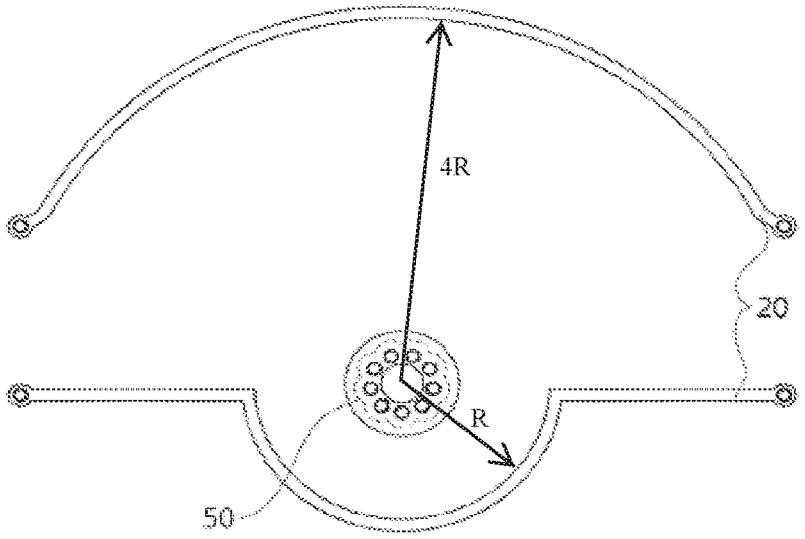
FIG. 5 is a view showing a second line.
Figure 6:
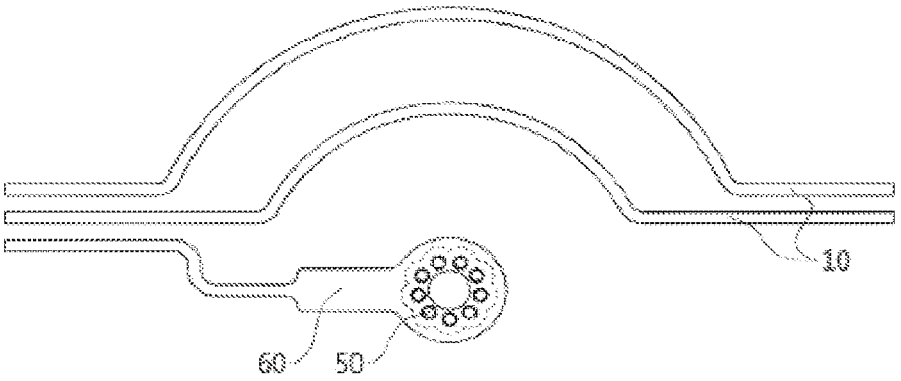
FIG. 6 is a view showing another embodiment of the first line.
Figure 7:
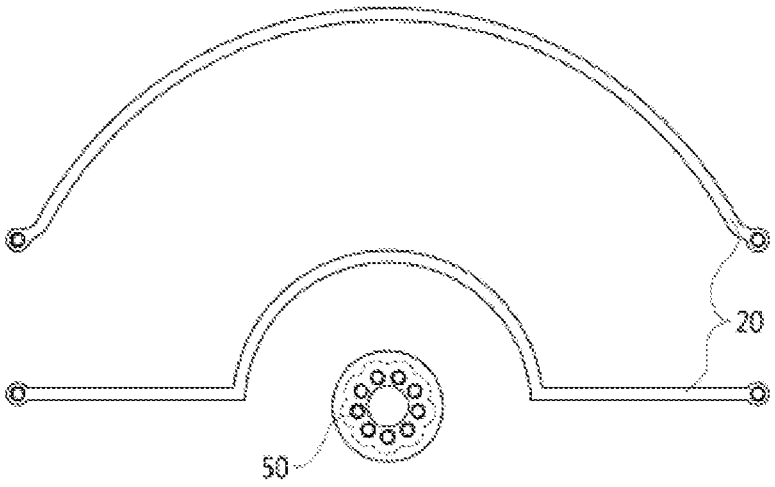
FIG. 7 is a view showing another embodiment of the second line.
Figure 8:
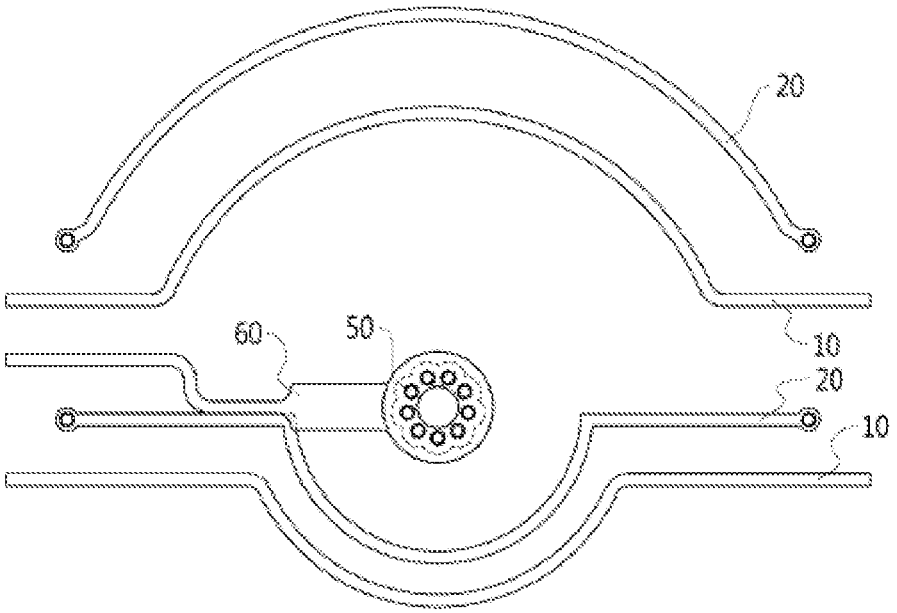
FIG. 8 is a view showing a first line and a second line together.
Figure 9:
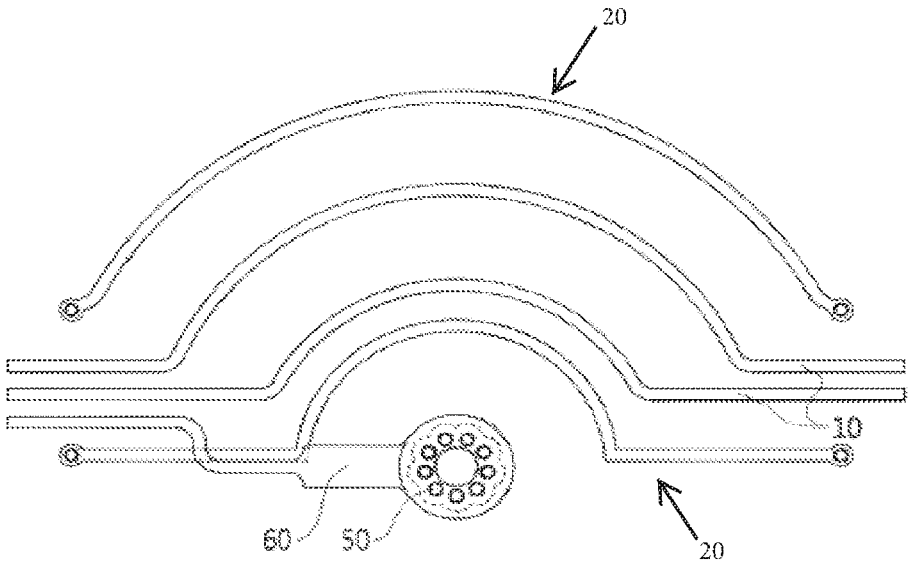
FIG. 9 is a view showing the first line and the second line together according to another embodiment.

The first line 10 and the second line 20, which are capable of shifting the phase of a power supply signal, are formed on the ground 5. Referring to FIGS. 4 and 5, the first line 10 (FIG. 4) is formed on one side of the ground 5 (FIGS. 2 and 3) and the second line 20 (FIG. 5) is formed on the other surface of the ground in a predetermined shape. Here, the first line 10 and the second line 20 may be formed as micro-strip lines spaced apart from the ground 5 by a predetermined distance through fixing columns. Specifically, the first line 10 and the second line 20 may include two or more lines formed in opposite directions. The shapes of the lines shown in FIGS. 4 and 5 are but one embodiment, and the first line 10 (FIG. 6) and the second line 20 (FIG. 7) may include two or more lines formed facing in the same direction as shown in FIGS. 6 and 7. That is, as both the first line 10 (FIG. 6) and the second line 20 (FIG. 7) are formed to include two or more lines, the lengths of the lines (more specifically, the lengths of the circumferences formed by the lines) may be different from each other. Thereby, the phase of an input signal can be changed. For example, the length of the lower line included in the second line 20 shown in FIG. 5 may be R, and the length of the upper line formed on the opposite side may be 4R. The length of the lower line included in the first line 10 shown in FIG. 4 may be 2R and the length of the upper line formed on the opposite side may be 3R. Thereby, the phase of the input signal may be sequentially changed according to the angle of rotation of third and fourth lines 30 and 40, which will be described later. The difference in length between the two or more lines included in the first line 10 and the second line 20 can be seen in FIG. 8, which shows the first line 10 and the second line 20 shown in FIGS. 4 and 5 together, and FIG. 9, which shows the first line 10 and the second line 20 shown in FIGS. 6 and 7 together. It should be noted that R to 4R representing the lengths of the lines are only one embodiment for sequentially changing the phase of the input signal, and it is needless to say that the phase of the input signal can be changed by variously changing the lengths of the lines. A more detailed description will be given later in the corresponding sections. Meanwhile, a plurality of additional lines may be formed in the shape of a trombone inside the first line 10 and the second line 20 shown in appropriate figures of FIGS. 4 to 7.

Figure 10:
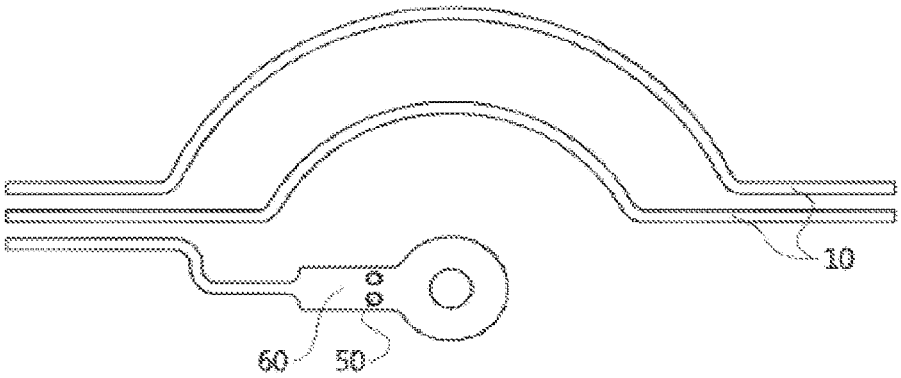
FIG. 10 is a view illustrating a via hole formed at a position spaced from the center of the ground by a predetermined distance.

Meanwhile, the first line 10 formed on one surface of the ground 5 (FIGS. 2 and 3) and the second line 20 formed on the other surface may be commonly fed through a via hole 50 to transmit an input signal. FIGS. 2 to 8 show that the via hole 50 is formed at the central portion of the ground 5, but this is only one embodiment and the via hole 50 may be formed at any position of the ground 5, as necessary. For example, it can be seen from FIG. 10 that the via hole 50 is not formed at the central portion of the ground 5 but is spaced apart from the central portion to the left by a predetermined distance. In this case, it is possible to prevent deterioration in antenna PIM (Passive Intermodulation) characteristics, which may be caused by rotation of the third line 30 and the fourth line 40. The position where the via hole 50 shown in FIG. 10 is formed is also only one embodiment. The via hole 50 may be preformed at any position where interference that may be caused by rotation of the third line 30 and the fourth line 40 can be prevented.

Hereinafter, the via hole 50 will be described in more detail. Referring to FIGS. 4 and 6, it can be seen that the feed line 60 (FIGS. 4 and 6) including the area where the via hole 50 is formed is arranged in the direction of 9 o'clock. Here, a feed cable (not shown) may be connected to an end of the feed line 60, which is thinner than other portions, and an input signal provided through the feed cable (not shown) may be introduced into the via hole along the feed line 60. The feed line 60 is preferably formed of a conductive material capable of transmitting the input signal.

Figure 11:
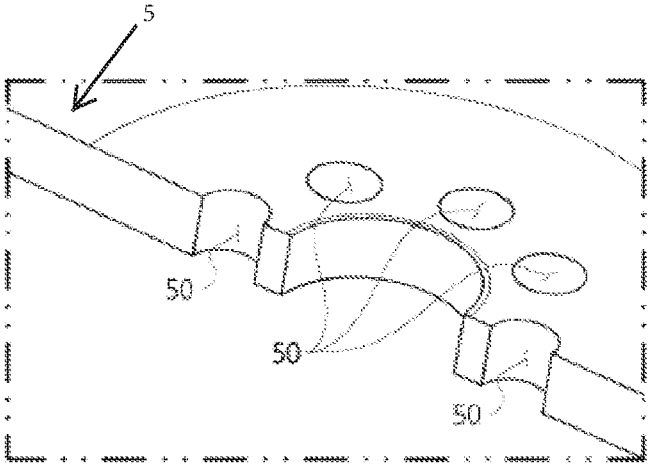
FIG. 11 is a view showing a cross section of the ground.

FIG. 11 is a view showing a cross section of the ground 5 according to an embodiment of the present invention. The via hole 50 is preferably covered with a conductive material like the feed line 60 (not shown) such that an input signal provided through the feed cable (not shown) can be transmitted. Specifically, the entire inner surface (for example, lateral surface of a cylinder) of the via hole 50 may be covered with a conductive material such that the input signal can be transmitted without interruption. In addition, a plurality of via holes 50 may be formed to ensure smooth transmission of the input signal. In this case, all the inner surfaces of the plurality of via holes 50 are preferably covered with a conductive material.

When the via hole 50 of FIG. 11 is formed as described above, the input signal is transmitted as follows. First, an input signal is introduced through a feed cable (not shown), and is transmitted along the feed line 60 formed on one surface of the ground 5 connected to the via hole 50. Then, the input signal is transmitted to the other surface of the ground 5 by the conductive material covering the via hole 50. In this case, the input signal may be transmitted by a coupling effect of the first line 10 with the feed line 60 and a coupling effect of the second line 20 with the via hole 50. In the case where a plurality of via holes 50 is formed, a similar transmission process will be performed.

With the via hole 50 of FIG. 11 formed as described above, simply forming lines on both surface of the ground 5 according to the present invention may obtain the same effect as combining two or more phase shifters. In addition, additional elements such as fixing columns and connecting columns which are needed to combine two or more phase shifters are not required, and therefore the volume of the phase shifter 100 may be remarkably reduced. Meanwhile, the connection portions of the feed line 60 or the feed cable (not shown) including the via hole 50 arranged in the direction of 9 o'clock direction are merely one embodiment, and they may be formed and connected in various ways as needed. Hereinafter, the process of changing the input signal according to rotation of the third line 30 and the fourth line 40 will be described in detail.

Figure 12:
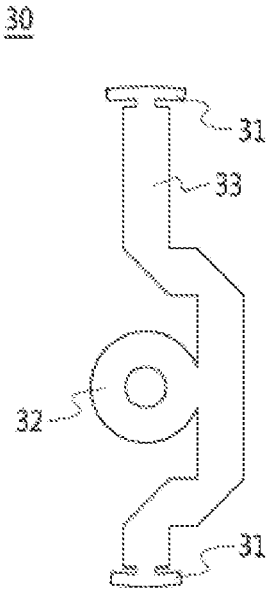
FIG. 12 is a view showing a third line.
Figure 13:
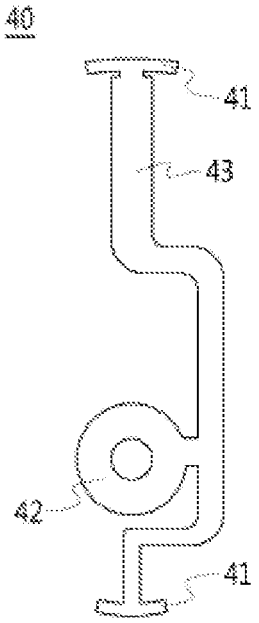
FIG. 13 is a view showing a fourth line.
Figure 14:
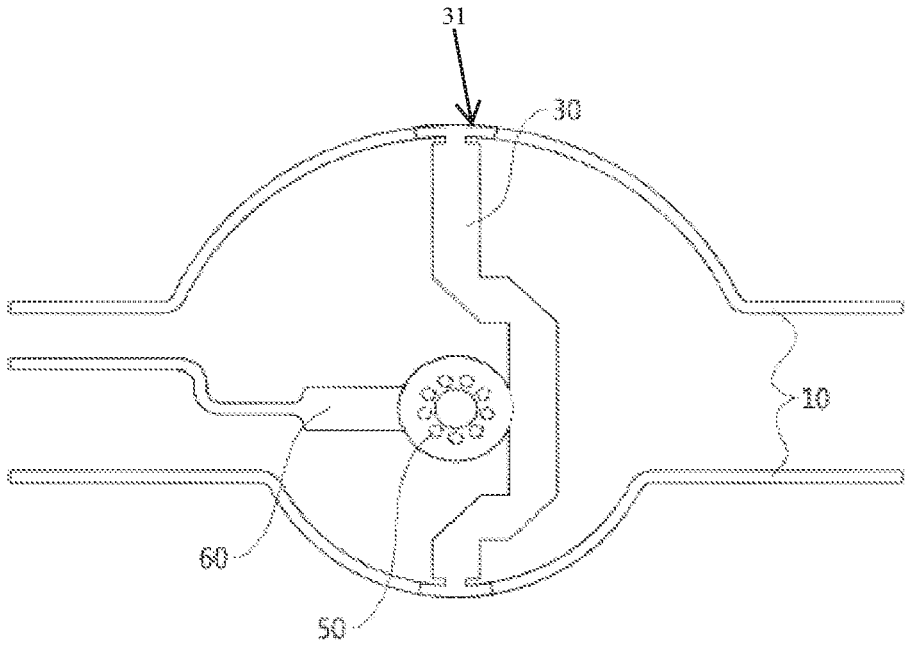
FIG. 14 is a view showing the first line and the third line together.

FIGS. 12 and 13 are views showing the third line 30 (FIG. 12) and the fourth line 40 (FIG. 13). FIG. 14 is a view showing the third line 30 (FIG. 12), arranged on the upper surface of the first line 10, and FIG. 15 is a view showing the fourth line 40 (FIG. 13) arranged on the upper surface of the second line 20.

Referring to FIGS. 12 and 13, the third line 30 (FIG. 12) and the fourth line 40 (FIG. 13) include a first line 10 (FIG. 14) including two or more lines at both ends of each of the lines, a "3-1"-st line portion 31 (FIG. 12) and "4-1"-st line portion 41 (FIG. 13) spaced a predetermined distance from and partially overlapping the second line 20 (FIG. 15), and a "3-2"-nd line portion 32 (FIG. 12) and "4-2"-nd line portion 42 (FIG. 13) for receiving an input signal from the via hole 50 (FIGS. 14, 15) through a coupling effect. In this case, the "3-2"-nd line portion 32 (FIG. 12) and the "4-2"-nd line portion 42 (FIG. 13) are preferably formed on the ground 5 (not shown) to include the entire area in which the via hole 50 (FIGS. 14, 15) is formed. For example, if a plurality of via holes 50 (FIGS. 14, 15) is formed in a circular shape as shown in FIG. 4, the "3-2"-nd line portion 32 (FIG. 12) and the "4-2"-nd line portion 42 (FIG. 13) may also be formed in a circular shape to include the entire area where the via hole 50 (FIGS. 14, 15) is formed on the ground 5. Additionally, the third line 30 (FIG. 12) and the fourth line 40 (FIG. 13), which will be described later, rotate by a predetermined angle counterclockwise/clockwise on the upper surfaces of the first line 10 (FIG. 14) and the second line 20 (FIG. 15), and accordingly they may interfere with the feed line 60 (FIG. 14) formed on the ground 5 during rotation. Accordingly, such interference may be avoided by arranging a "3-3"-rd line portion 33 (FIG. 12) and a "4-3"-rd line portion 43 (FIG. 13) so as to face in the direction opposite to the direction in which the feed line 60 (FIG. 14) is arranged. For example, when the feed line 60 (FIG. 14) is arranged in the direction of 9 o'clock as shown in FIG. 4, the "3-3"-rd line portion 33 (FIG. 12) and the "4-3"-rd line portion 43 (FIG. 13) may be arranging so as to face the direction of 3 o'clock. The third line 30 (FIG. 12) and the fourth line 40 (FIG. 13) are formed in the same manner as the first line 10 and the second line 20 described above with reference to FIGS. 2-10.

Figure 15:
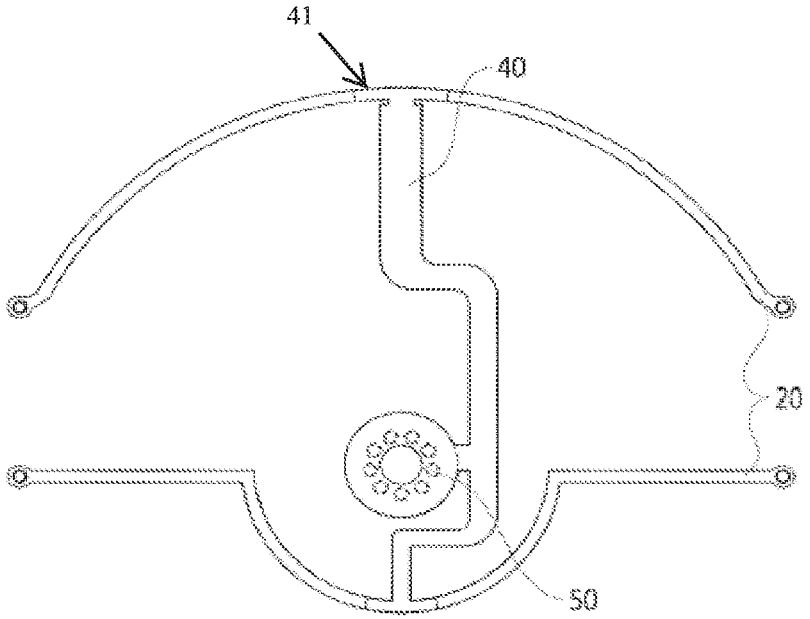
FIG. 15 is a view showing the second line and the fourth line together.

Referring to FIGS. 14 and 15, the third line 30 (FIG. 14) and the fourth line 40 (FIG. 15) are spaced apart from the upper surfaces of the first line 10 (FIG. 14) and the second line 20 (FIG. 15) by a predetermined distance such that portions 31 (FIG. 14) and 41 (FIG. 15) thereof face each other. Accordingly, the third line 30 and the first line 10, and the fourth line 40 (FIG. 15) and the second line 20 (FIG. 15) may be electrically connected to each other. Specifically, an input signal transmitted through the feed line 60 (FIG. 14) is transmitted to the first line 10 by a coupling effect, and the third line 30 may be electrically connected to the first line 10 and the via hole 50 by the coupling effect such that the input signal can be transmitted. In the case of the fourth line 40, the input signal may be transmitted to the second line through the coupling effect with the input signal transmitted to the via hole 50, and similarly, the fourth line 20 may be electrically connected to the second line and the via hole 50 by the coupling effect with the second line 20 and the via hole 50 such that the input signal can be transmitted. Therefore, in the multi-port phase shifter according to an embodiment of the present invention, an input signal may be transmitted to all the lines even in the case where only one input signal is applied.

The third line 30 and the fourth line 40 are rotatable by a predetermined angle on the upper surfaces of the first line 10 and the second line 20. For example, referring to FIGS. 14 and 15, the third line 30 and the fourth line 40 forming an angle of 90° with the first line and the second line 20 may rotate counterclockwise/clockwise by a predetermined angle. More specifically, the "3-1"-st line portion 31 (FIG. 12) and the "4-1"-st line portion 41 (FIG. 13), which are included in the third line 30 and the fourth line 40, may rotate counterclockwise/clockwise until they reach both ends of the arc-shaped lines included in the first line 10 and the second line 20, and rotate by the same angle in the same direction. For example, in the case of FIGS. 14 and 15, the third line 30 and the fourth line 40 can rotate by about −60° (counterclockwise) to +60° (clockwise) from the position (0°) shown in the figures, and the case of FIG. 17, which will be described later, will be the same. The predetermined angle by which the third line 30 and the fourth line 40 rotate may be differently set according to the lengths of the arc lines included in the first line 10 and the second line 20.

The left and right sides of the first line 10 and the second line 20 may be configured as individual ports depending on the positions of the third line 30 and the fourth line 40. As the third line 30 and the first line 40 rotate counterclockwise/clockwise by a predetermined angle, the lines of the individual ports of the first line 10 and the second line 20 are elongated or shortened. Accordingly, when the lengths of the ports are shortened, the phase of the input signal is shortened. When the lengths of the ports are elongated, the phase of the input signal may be delayed. For example, if the fourth line 40 rotates counterclockwise by an angle Φ in degrees or radians (hereafter, Φ), the phase of the input signal on the left side of the line R formed below the second line 20 with respect to the position of the fourth line 40 will be shortened by −Φ (since the length of the line is shortened), and the phase of the input signal on the right side of the line R will be delayed by +Φ (since the length of the line increases). In this case, on the line 4R arranged in the opposite direction, the phase of the input signal will be shortened or delayed by −4Φ or by +4Φ. The third line 30 and the fourth line 40 rotate by the same angle in the same direction. Accordingly, in the above embodiment, the phase of the input signal will be shortened by −2Φ on the left side of the line 2R formed below the first line 10 with respect to the position of the third line 30, and will be delayed on the right side by +2Φ. The phase of the input signal will be shortened or delayed by −3Φ or by +3Φ on the line 3R arranged in the opposite direction. That is, as the third line 30 and the fourth line 40 rotate counterclockwise by Φ, the phase of the input signal may be changed to −4Φ, −3Φ, −2Φ, −Φ, +Φ, +2Φ, +3Φ, +4Φ. Therefore, electrical beam tilting of a radiation pattern radiated by a plurality of radiation elements (not shown) connected to the first line 10 and the second line 20 may occur. Meanwhile, rotation of the third line 30 and the fourth line 40, which may cause phase shift of the input signal, may be adjusted by a separate controller (not shown), may be manually adjusted, or may be adjusted using RET (Remote Electrical Tilt) technology for controlling rotation by remotely operating a motor. Both ends or the center of the third line 30 and the first line 40 may include a fixing column (not shown) for rotating the third line 30 and the fourth line 40 simultaneously. Change of the phase of the input signal according to counterclockwise movement of the third line 30 and the fourth line 40 by Φ described above is merely one embodiment, and the phase of the input signal may be shifted by adjusting rotation in various ways as needed.

Figure 16:
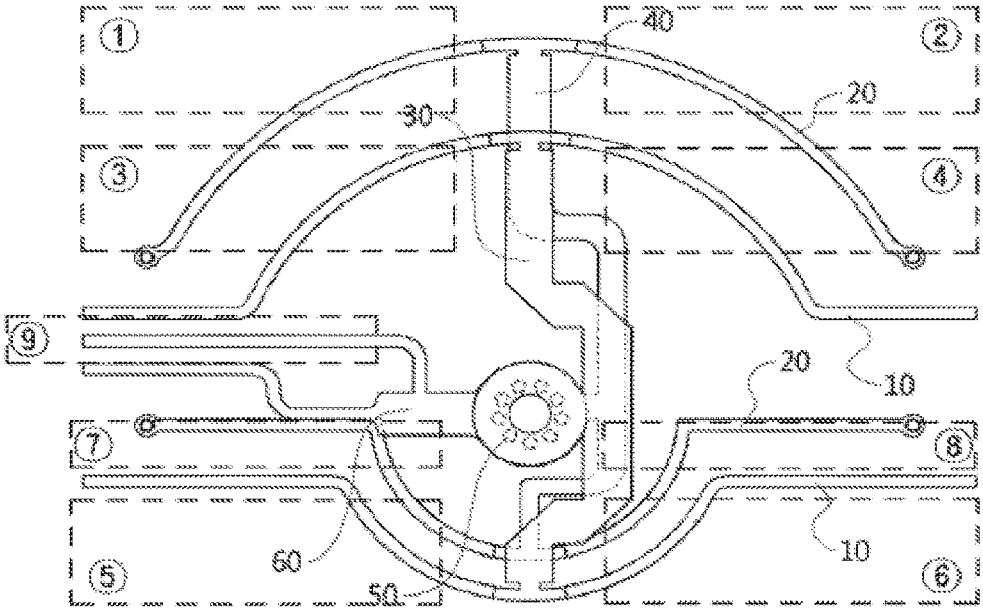
FIG. 16 is a view showing a multi-port phase shifter with nine ports.
Figure 17:
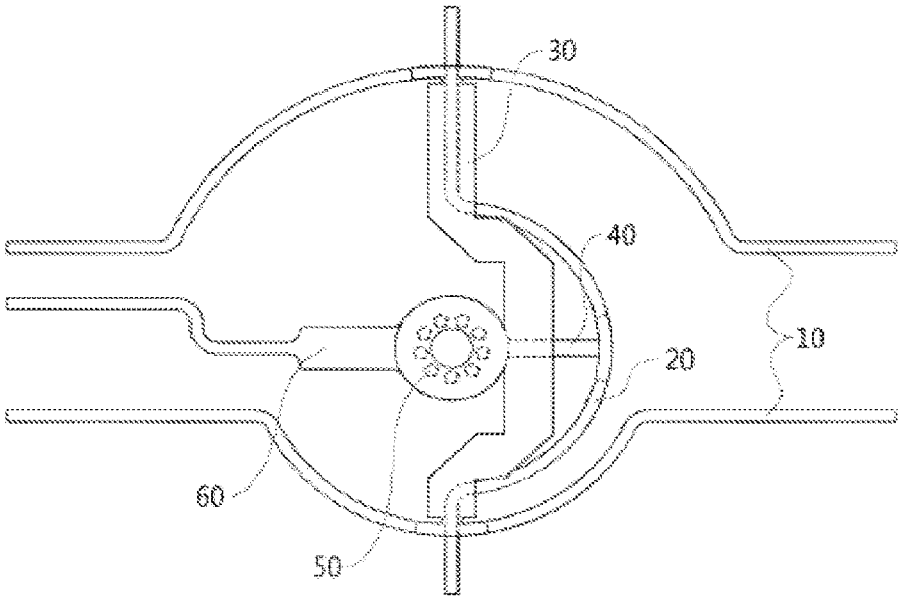
FIG. 17 is a view showing a second line and a fourth line together according to another embodiment.
Figure 18:
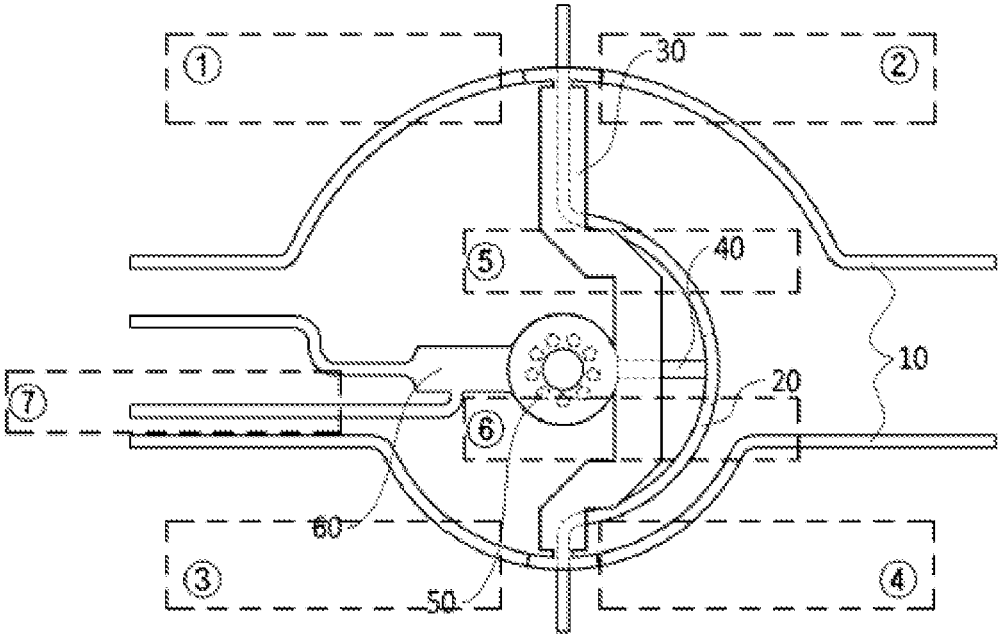
FIG. 18 is a view showing a multi-port phase shifter with seven ports.

Meanwhile, the phase shifter 100 may be implemented with multiple ports by the third line 30 and the fourth line 40 described above. The third line 30 may form four ports by dividing the upper line of the first line 10 and the line on the opposite side into the left and the right portions. The fourth line 40 may also form four ports by dividing the upper line of the second line 10 and the line on the opposite side into left and right portions. In addition, 9 ports (labeled 1-9 in FIG. 16) may be implemented in one phase shifter 100 by additionally forming one port on the feed line 60 formed on the ground (FIGS. 2, 3), which is shown in FIG. 16. In the case where the second line 20 includes only one line as shown in FIG. 17 and is arranged to form an angle of 90° with the first line 10, all seven ports (e.g., ports 1-7 of FIG. 18) may be implemented in one phase shifter 100 in a manner that the third line 30 divides the upper line and the opposite line of the first line 10 into left and right portions to form four ports, the fourth line 40 divides the upper line and the opposite line of the second line 10 into left and right portions to form two ports, and one port is additionally formed on the feed line 60 formed on the ground 5 (FIGS. 2, 3). In addition, when the second line 20 is arranged as shown in FIG. 17, it is possible to prevent interference with the feed line 60, which may be caused by rotation of the third line 30 and the fourth line 40. When one port is not additionally provided on the feed line 60, eight ports may be implemented in the phase shifters 100 of FIG. 16, and six ports may be implemented in the phase shifters 100 of FIG. 17. Therefore, any of the above cases is applicable to a sector antenna for obtaining a high gain.

Figure 19:
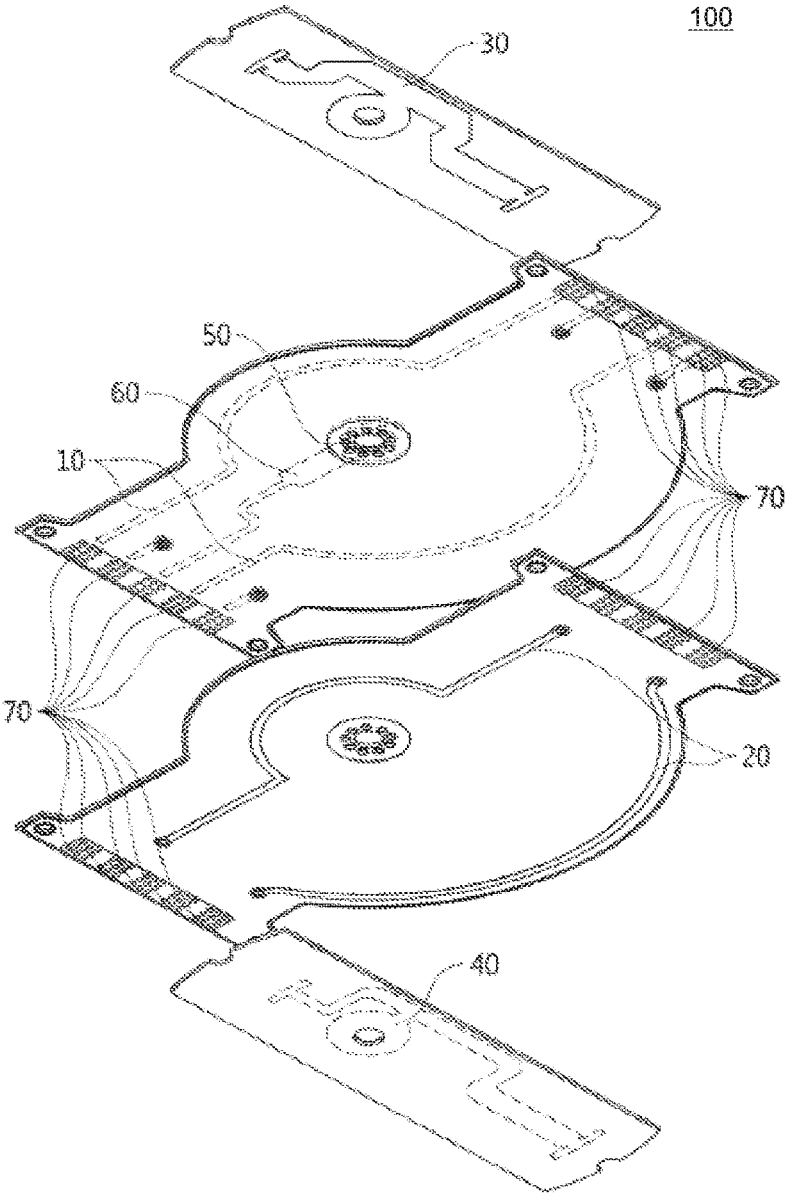
FIG. 19 is a view showing a multi-port phase shifter including a dielectric substrate.
Figure 20:
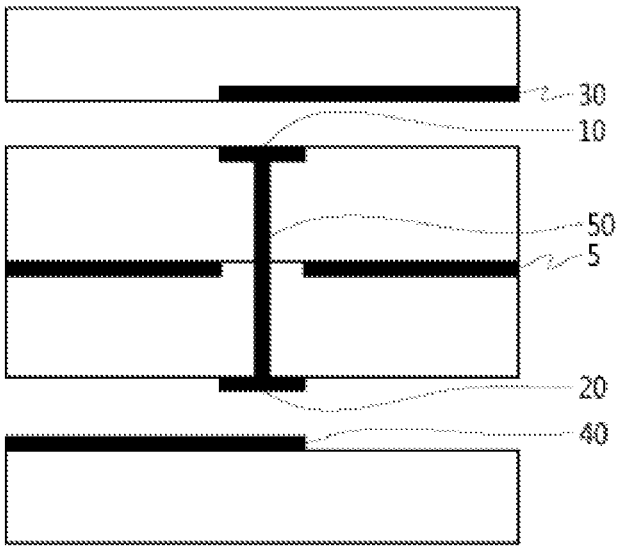
FIG. 20 is a cross-sectional view illustrating a multi-port phase shifter including a dielectric substrate.

In the multi-port phase shifter 100 according to an embodiment of the present invention, the first to fourth lines 10, 20, 30, and 40 may be formed on dielectric substrates. FIG. 19 shows a multi-port phase shifter 100 including dielectric substrates. In this case, referring to FIG. 20, the ground 5 may be formed between the dielectric substrate on which the first line 10 is formed and the dielectric substrate on which the second line 20 is formed, and the via hole 50 may be formed between the dielectric substrate on which the first line 10 is formed and the dielectric substrate on which the second line 20 is formed. Even if dielectric substrates are included, all of the technical features of the multi-port phase shifter 100 described above may be included. In addition, new technical features may be added as the dielectric substrates are included. For example, referring to FIG. 19, one or more via holes 70 may be formed at both ends of the dielectric substrates. In this case, an electric signal may be applied to each of the plurality of input/output ports described above through one or more via holes 70 to which a feed cable is connected, and the existing feed line 60 may only serve as a port. Meanwhile, the via hole 70 may also be formed at both ends of the ground 5 (FIGS. 2, 3).

The embodiments of the present invention described above are illustrative, and the present invention is not limited thereto. It will be apparent to those skilled in the art that various modifications and variations can be made in the present invention without departing from the spirit and scope of the invention.

The invention claimed is:

1. A multi-port phase shifter comprising:

a ground;

a first line formed at a first surface of the ground;

a second line formed at a second surface of the ground, the second surface of the ground being a back side surface opposite to the first surface of the ground;

a third line spaced apart from an upper surface of the first line by a predetermined distance and a portion of the third line being arranged to face the upper surface;

a fourth line spaced apart from a lower surface of the second line by a predetermined distance and a portion of the fourth line being arranged to face the lower surface;

a via hole formed through the ground; and a feed line formed on the first surface of the ground so as to include an area where the via hole is formed, wherein the second line receives an input signal through a coupling effect with the via hole included in the feed line.

2. The multi-port phase shifter according to claim 1, wherein the first to fourth lines are individually formed on first to fourth dielectric substrates.

3. The multi-port phase shifter according to claim 1, wherein the first line receives an input signal through a coupling effect with the feed line.

4. The multi-port phase shifter according to claim 3, wherein the third line receives the input signal through a coupling effect with the first line and the via hole.

5. The multi-port phase shifter according to claim 1, wherein the fourth line receives the input signal through a coupling effect with the second line and the via hole.

6. The multi-port phase shifter according to claim 1, wherein the via hole comprises a plurality of via holes formed through the ground.

7. The multi-port phase shifter according to claim 1, wherein an entire inner surface of the via hole is covered with a conductive material.

8. The multi-port phase shifter according to claim 1, wherein the third line and the fourth line are respectively rotatable by a corresponding predetermined angle.

9. The multi-port phase shifter according to claim 1, wherein the second line comprises two or more lines formed in opposite directions on the second surface of the ground.

10. The multi-port phase shifter according to claim 9, wherein the two or more lines included in the second line have different lengths.

11. The multi-port phase shifter according to claim 1, wherein the first line is sectioned into two or more ports by the third line.

12. The multi-port phase shifter according to claim 1, wherein the second line is sectioned into two or more ports by the fourth line.

13. The multi-port phase shifter according to claim 1, wherein the first line comprises two or more lines formed in opposite directions on the first surface of the ground.

14. The multi-port phase shifter according to claim 13, wherein the two or more lines included in the first line have different lengths.

15. The multi-port phase shifter according to claim 1, wherein the second line is arranged at an angle of 90° with respect to the first line.

16. A multi-port phase shifter comprising:

a ground;

a first line formed at a first surface of the ground;

a second line formed at a second surface of the ground, the second surface of the ground being a rear side surface opposite to the first surface of the ground;

a third line spaced apart from an upper surface of the first line by a predetermined distance and a portion of the third line being arranged to partially face the upper surface;

a fourth line spaced apart from a lower surface of the second line by a predetermined distance and a portion of the fourth line being arranged to face the lower surface;

a via hole formed through the ground; and a feed line formed on the first surface of the ground so as to include an area where the via hole is formed, wherein the first line is formed as a micro-strip line spaced apart from the first surface of the ground and the second line is formed as a micro-strip line spaced apart from the second surface of the ground, respectively, by a predetermined distance through fixing columns.

* * * * *